US005697773A

United States Patent [19]

Mendoza et al.

[11] Patent Number: 5,697,773

[45] Date of Patent: Dec. 16, 1997

[54] ROTARY FLUID REACTION DEVICE HAVING HINGED VANES

[75] Inventors: José L. Mendoza, Rancho Cordova; Philip Theodore Lingman, Cotati; William Richard Maclay, Sr., Los Gatos, all of Calif.

[73] Assignee: Denticator International, Inc., Sacramento, Calif.

[21] Appl. No.: 294,621

[22] Filed: Aug. 23, 1994

[51] Int. Cl.[6] ..... F01C 1/00

[52] U.S. Cl. ..... 418/236; 418/259; 415/141

[58] Field of Search ..... 418/225, 227, 418/259, 266, 236; 415/141

[56] References Cited

U.S. PATENT DOCUMENTS

| | | | |
|---|---|---|---|
| Re. 24,391 | 10/1957 | McFadden . | |
| 263,814 | 9/1882 | Schmitz . | |
| 969,378 | 9/1910 | Krause . | |
| 1,343,115 | 6/1920 | Current | 418/266 |
| 1,601,397 | 9/1926 | Kochendarfer | 418/266 |

(List continued on next page.)

FOREIGN PATENT DOCUMENTS

| | | | |
|---|---|---|---|
| 646193 | 6/1937 | Germany . | |
| 803306 | 7/1949 | Germany | 418/225 |
| 102433 | 5/1951 | New Zealand . | |
| 12584 | 3/1903 | Sweden | 418/266 |
| 2154283 | 9/1985 | United Kingdom . | |
| 2 209 284 | 5/1989 | United Kingdom . | |

OTHER PUBLICATIONS

Denticator; Product Brochure; 1990; entire brochure.

Oralsafe; Advertisement for oralsafe disposable handpiece; Dentistry Today Trade Journal; Aug. 1992; entire advertisement.

SmartPractice; Advertisement for a smart angle prophy angle; entire advertisement.

Dental Products Report, "Disposable Handpiece", Nov. 1992, p. 96.

Diversified Dental Supply, Inc., Advertisement for Disposable High Speed Hand Pieces, entire advertisement.

The National Magazine for Dental Hygiene Professionals, Product Report, "Prophy Cups", Jan. 1992, p. 38.

Dental Products Report, New Products, "Prophy Cups", Jan. 1992, p. 30.

*Primary Examiner*—Charles Freay

*Attorney, Agent, or Firm*—Bernhard Kreten

[57] ABSTRACT

A fluid reaction device 10 is provided having a rotor 90 with vanes 92 pivotably connected thereto. The device 10 includes an entrance 30 for elevated pressure fluid and an outlet 40 for discharge of the fluid after contacting the rotor 90. The elevated pressure fluid passes from the entrance 30, into a high pressure chamber 80. The high pressure chamber 80 is in contact with inlet ports 74 accessing a cylinder 72 within the device 10. The cylinder 72 supports the rotor 90 with a rotational axis M of the rotor 90 off center with respect to a central axis N of the cylinder 72. The elevated pressure fluid causes the rotor 90 and an attached output shaft 97 to rotate. The rotor 90 includes a trunk 24 with a plurality of posts 93 extending therefrom and with vanes 92 connected to the posts 93 through hinges 94. The vanes 92 can pivot from a first position collapsed against the trunk 24 to a second position spaced away from the trunk 24. The vanes 92 thus can contact a cylindrical wall 78 of the cylinder 72 while the rotor 90 rotates. Exhaust ports 76 are spaced from the inlet ports 74 and provide communication with a low pressure chamber 82 which exhausts low pressure fluid to the outlet 40.

17 Claims, 6 Drawing Sheets

U.S. PATENT DOCUMENTS

| | | | |
|---|---|---|---|
| 1,999,488 | 4/1935 | Swisher et al. . | |
| 2,017,881 | 10/1935 | Wiseman . | |
| 2,025,779 | 12/1935 | Roelke . | |
| 2,033,662 | 3/1936 | Witt . | |
| 2,128,157 | 8/1938 | Monnier et al. . | |
| 2,135,933 | 10/1938 | Blair . | |
| 2,203,974 | 6/1940 | Weinhardt | 415/141 |
| 2,226,145 | 12/1940 | Smith . | |
| 2,300,828 | 11/1942 | Goldenberg . | |
| 2,315,016 | 3/1943 | Shotton . | |
| 2,328,270 | 8/1943 | Greenberg . | |
| 2,463,118 | 3/1949 | Moore | 418/266 |
| 2,586,968 | 11/1952 | MaClay . | |
| 2,684,035 | 7/1954 | Kemp . | |
| 2,789,352 | 4/1957 | Wiseman . | |
| 2,836,877 | 6/1958 | Hannahan . | |
| 2,933,046 | 4/1960 | McCray . | |
| 2,937,444 | 5/1960 | Kern . | |
| 3,043,274 | 7/1962 | Quakenbush | 418/236 |
| 3,054,355 | 9/1962 | Neely . | |
| 3,163,934 | 1/1965 | Wiseman . | |
| 3,192,922 | 7/1965 | Winkler . | |
| 3,229,369 | 1/1966 | Hoffmeister et al. . | |
| 3,309,965 | 3/1967 | Weickgenannt . | |
| 3,376,825 | 4/1968 | Burnett | 418/266 |
| 3,421,224 | 1/1969 | Brehm et al. . | |
| 3,477,793 | 11/1969 | Kitagawa . | |
| 3,510,229 | 5/1970 | Smith | 415/141 |
| 3,719,440 | 3/1973 | Snider . | |
| 3,727,313 | 4/1973 | Graham . | |
| 3,740,853 | 6/1973 | Brahler . | |
| 3,855,704 | 12/1974 | Booth . | |
| 3,856,432 | 12/1974 | Campagnuolo et al. . | |
| 3,877,574 | 4/1975 | Killick . | |
| 3,942,392 | 3/1976 | Page, Jr. et al. . | |
| 3,955,284 | 5/1976 | Balson . | |
| 3,987,550 | 10/1976 | Danne et al. . | |
| 4,040,311 | 8/1977 | Page, Jr. et al. . | |
| 4,053,983 | 10/1977 | Flatland . | |
| 4,171,571 | 10/1979 | Gritter . | |
| 4,182,041 | 1/1980 | Girard . | |
| 4,185,386 | 1/1980 | Nordin et al. . | |
| 4,248,589 | 2/1981 | Lewis . | |
| 4,259,071 | 3/1981 | Warden et al. . | |
| 4,266,933 | 5/1981 | Warden et al. . | |
| 4,365,956 | 12/1982 | Bailey . | |
| 4,392,779 | 7/1983 | Bloemers et al. . | |
| 4,465,443 | 8/1984 | Kardén . | |
| 4,540,337 | 9/1985 | Olsen . | |
| 4,693,871 | 9/1987 | Geller . | |
| 4,747,277 | 5/1988 | Buse . | |
| 4,795,343 | 1/1989 | Choisser . | |
| 4,842,516 | 6/1989 | Choisser . | |
| 4,846,638 | 7/1989 | Pahl et al. . | |
| 4,863,344 | 9/1989 | Stefanini . | |
| 4,929,180 | 5/1990 | Moreschini . | |
| 4,941,828 | 7/1990 | Kimura . | |
| 5,020,994 | 6/1991 | Huang . | |
| 5,028,233 | 7/1991 | Witherby . | |
| 5,040,978 | 8/1991 | Falcon et al. . | |
| 5,062,796 | 11/1991 | Rosenberg . | |
| 5,094,615 | 3/1992 | Bailey . | |
| 5,120,220 | 6/1992 | Butler . | |
| 5,156,547 | 10/1992 | Bailey . | |
| 5,163,825 | 11/1992 | Oetting . | |

ROTARY FLUID REACTION DEVICE HAVING HINGED VANES

This invention generally relates to motors and fluid reaction devices which utilize elevated pressure gases or liquids to generate rotational shaft output. More specifically, this invention relates to hand held fluid driven motors with high torque and relatively low speed when unloaded and including rotors with dynamic vanes which move relative to the rotor.

BACKGROUND OF THE INVENTION

Fluid driven motors are known in the art which utilize elevated pressure or elevated velocity gases, such as air, to cause a shaft to rotate so that work can be done. Some prior art devices date back to around 1873, when steam power systems were being developed. In general, the high velocity fluid driven motors include a fixed vane rotor and a fixed vane stator. A nozzle directs the high velocity air against the fixed vanes of the rotor, causing rotor rotation. Such fixed rotor fluid driven motors generally exhibit extremely high free speeds, speeds exhibited when no load is placed on the motor, especially when sized to be hand held.

Many different types of fluid motors are known in the art that have been used with many different liquids and gases, including steam, compressed air and water. One type converts a high velocity stream of fluid (kinetic energy type) into mechanical rotation. These range from large water turbines that are used in hydroelectric generating plants and aircraft jet engines to very small dental drills that are used in filling teeth. The speed of a turbine dental drill ranges from 500,000 to a million RPM, and produces a very low torque. The jet engine typically turns at approximately 25,000 RPM and produces a high torque by having many stages of redirection of the gas stream and many expansion stages.

Another common type of motor uses static fluids under pressure to produce mechanical motion (potential energy type). Typical motors of this type use pressure against pistons to produce motion. Examples of this type include automobile engines and steam locomotives. Another type of static fluid pressure motor does not require a crank or similar mechanism to convert the fluid pressure to shaft rotation. In these motors, often referred to as a vane type, the pressure is applied directly against the vanes, which are coupled to the shaft. In contrast to pistons which have a fixed area exposed to the fluid pressure, the well known vane motor presents an area that ranges from zero to a maximum, in half of a revolution.

These prior art rotors which rely on static fluid pressure include a dynamic rotor having flat vanes which slide away from and toward a geometric center of the rotor. The rotor is located asymmetrically within a cylinder such that air passing from an inlet to an outlet within the cylinder causes the rotor to rotate in only one direction. The vanes slide away from and toward a rotational axis of the rotor as the rotor rotates. Because such sliding flat vane rotors contact a wall of the cylinder, friction exists which determines a maximum free speed of the rotor for a given air pressure. Such motors also exhibit relatively high torque at lower speeds than high velocity air motors.

While such sliding flat vane rotors are useful for many applications, some applications require higher torque at still lower speeds than those obtainable with flat sliding vane rotors. Gearing the output shaft to obtain desired speeds is often excessively complex or expensive for many applications. The sliding vanes are also constrained geometrically to exhibit only slight extension, to prevent excessive shear stress on the vanes. Additionally, flat sliding vane rotors require some form of system to extend the vanes away from the rotor at start up, before centrifugal forces can be utilized to maintain the vanes against a surrounding cylindrical wall. The fluid pressure does not inherently cause the vanes to extend. Finally, such flat sliding vane rotors must be formed with multiple pieces and to precise tolerances to ensure that the vanes can effectively slide within slots in the rotor. Accordingly, a need exists for a fluid driven motor or fluid reaction device which has high torque at low speeds but which is sufficiently easily manufactured to facilitate economical disposability and has vanes which extend readily when the device is started. Additionally, a need exists for a fluid reaction device which has a high torque at low speeds without the use of gears.

The following prior art reflects the state of the art of which applicant is aware and is included herewith to discharge applicant's acknowledged duty to disclose relevant prior art. However, it is respectfully submitted that none of these prior art devices teach singly, nor render obvious when considered in any conceivable combination, the nexus of the instant invention as especially claimed hereinafter.

| INVENTOR | PATENT NO. | ISSUE DATE |
|---|---|---|
| Schmitz | 263,814 | September 5, 1882 |
| Swisher, et al | 1,999,488 | April 30, 1935 |
| Wiseman | 2,017,881 | October 22, 1935 |
| Roelke | 2,025,779 | December 31, 1935 |
| Monnier, et al. | 2,128,157 | August 23, 1938 |
| Blair | 2,135,933 | November 8, 1938 |
| Smith | 2,226,145 | December 24, 1940 |
| Goldenberg | 2,300,828 | November 3, 1942 |
| Shotton | 2,315,016 | March 30, 1943 |
| Greenberg | 2,328,270 | August 31, 1943 |
| Wiseman | 2,789,352 | April 23, 1957 |
| McFadden | Re. 24, 391 | November 12, 1957 |
| Kern | 2,937,444 | May 24, 1960 |
| Wiseman | 3,163,934 | January 5, 1965 |
| Winkler | 3,192,922 | July 6, 1965 |
| Hoffmeister, et al. | 3,229,369 | January 18, 1966 |
| Brehm, et al. | 3,421,224 | January 14, 1969 |
| Smith | 3,510,229 | May 5, 1970 |
| Graham | 3,727,313 | April 17, 1973 |
| Brahler | 3,740,853 | June 26, 1973 |
| Booth | 3,855,704 | December 24, 1974 |
| Campagnuolo, et al. | 3,856,432 | December 24, 1974 |
| Killick | 3,877,574 | April 15, 1975 |
| Balson | 3,955,284 | May 11, 1976 |
| Danne, et al. | 3,987,550 | October 26, 1976 |
| Flatland | 4,053,983 | October 18, 1977 |
| Gritter | 4,1,71,571 | October 23, 1979 |
| Girard | 4,182,041 | January 8, 1980 |
| Lewis | 4,248,589 | February 3, 1981 |
| Warden et al. | 4,259,071 | March 31, 1981 |
| Melcher | 4,261,536 | April 14, 1981 |
| Warden et al. | 4,266,933 | May 12, 1981 |
| Bailey | 4,365,956 | December 28, 1982 |
| Karden | 4,465,443 | August 14, 1984 |
| Geller | 4,693,871 | September 15, 1987 |
| Buse | 4,767,277 | August 30, 1988 |
| Choisser | 4,795,343 | January 3, 1989 |
| Choisser | 4,842,516 | June 27, 1989 |
| Stefanini | 4,863,344 | September 5, 1989 |
| Moreschini | 4,929,180 | May 29, 1990 |
| Kimura | 4,941,828 | July 17, 1990 |
| Huang | 5,020,994 | June 4, 1991 |
| Witherby | 5,028,233 | July 2, 1991 |
| Falcon et al. | 5,040,978 | August 20, 1991 |
| Rosenberg | 5,062,796 | November 5, 1991 |
| Bailey | 5,094,615 | March 10, 1992 |
| Butler | 5,120,220 | June 9, 1992 |

-continued

| Bailey | 5,156,547 | October 20, 1992 |
|---|---|---|

FOREIGN PATENT DOCUMENTS

| DOCUMENT NUMBER | DATE | NAME | CLASS | SUB-CLASS* | FILING DATE |
|---|---|---|---|---|---|
| 646,193 (Germany) | 06/1937 | Dürhager | 30b | 202 | 5/1937 |
| 102,433 (New Zealand) | 05/1951 | Callaghan | 433 | 132 | |
| GB 2 209 284-A | 05/1989 | Kalsha | A61C | 1/05 | 07/1988 |
| Fed. Republic of Germany | | 646,193 | | June, 1937 | |

OTHER PRIOR ART (Including Author, Title, Date, Pertinent Pages, Etc.)

Lewis, Advertisement for Oralsafe Disposable Handpiece Dentistry Today, August 1992

Denticator; Product Brochure; 1990; entire brochure.

Oralsafe; Advertisement for Oralsafe Disposable Handpiece; Dentistry Today Trade Journal; August, 1992; entire advertisement.

SmartPractice; Advertisement for a smart angle prophy angle; entire advertisement.

Dental Products Report, "Disposable Handpiece", November 1992, page 96.

Diversified Dental Supply, Inc., Advertisement for Disposable High Speed Hand Pieces, entire advertisement.

The National Magazine for Dental Hygiene Professionals, Product Report, "Prophy Cups", January 1992, page 38.

Dental Products Report, New Products, "Prophy Cups", January 1992, page 30.

Oralsafe; Advertisement for Oralsafe disposable handpieces; Impact, The Newsmagazine of the Academy of General Dentistry, December 1992; entire advertisement.

The patent to Smith teaches a one-way pump with an impeller having blades connected to the impeller through a flexible web portion which allows the blades to be pivoted in one direction but not the other. The present invention is distinguishable from Smith for several reasons. Inter alia, shaft power is provided for an output shaft instead of pumping fluid through a system. Also, the vanes of this invention contact a cylinder wall and the rotor of this invention is offset within the cylinder within which it resides.

The patent to Stefanini teaches a centrifugal pump having impeller blades which are pivoted to rotate between two extreme positions. The present invention is distinguishable from the pump taught by Stefanini in that, inter alia, the present invention provides a fluid reaction device producing shaft rotation instead of fluid pumping. Also, the vanes of this invention contact a cylindrical wall surrounding the vanes, and the rotor of this invention is oriented offset with respect to a center of the cylinder within which it rotates.

The remainder of the prior art diverge even more starkly from the present invention than the prior art specifically distinguished above.

SUMMARY OF THE INVENTION

The fluid reaction device of this invention utilizes fluid, such as air under elevated pressure, to cause a shaft to rotate and do useful work. The device includes a rotor with vanes extending therefrom. The rotor is coupled to an output shaft. The rotor is supported within a cavity which allows rotation of the rotor therein. Inlet ports and exhaust ports pass into the cavity to allow fluid under elevated pressure to enter the cavity and reduced pressure fluid to exit the cavity. The inlet ports are coupled to a source of elevated pressure fluid.

The rotor is supported so that a rotational axis of the rotor is spaced from a central axis of symmetry of the cavity Thus, the rotor is oriented off-center within the cavity. The vanes of the rotor are pivotably attached to the rotor such that the vanes can contact the cavity wall at all times by pivoting away from and toward the rotor as the rotor rotates. The pivoting vanes deter fluid from passing around the rotor without rotor rotation. The pivoting vanes also generate friction for the rotor, acting as a governor by keeping the rotor from exceeding a maximum free speed for the device. The pivoting vanes are entirely exposed to the driving fluid at all times, maximizing a reaction surface for the high energy fluid. The pivoting vanes provide the rotor with a greater radius on one side of the rotor than on an opposite of the rotor. This difference increases a torque imparted by the rotor to the output shaft.

In one form of the invention, the inlet ports and exhaust ports enter the cavity at an end thereof substantially parallel to an axis of rotation of the rotor. In this form, the inlet fluid and outlet fluid need not be channeled around the cavity, allowing a width of the cavity to be reduced. Hence an exterior width of a housing supporting the cavity can be reduced.

OBJECTS OF THE INVENTION

Accordingly, it is a primary object of the present invention to provide a fluid reaction device having low speed and high torque characteristics.

It is another object of the present invention to provide a fluid reaction device including a rotor which is caused to rotate by elevated pneumatic fluid pressure.

It is another object of the present invention to provide a fluid reaction device which is self-starting.

Another object of the present invention is to provide a fluid reaction device having a rotor formed from low cost easily machined materials.

Another object of the present invention is to provide a fluid reaction device formed from injection moldable plastic materials.

Another object of the present invention is to provide a fluid reaction device which can produce torque without rotation.

It is another object of the present invention to provide a fluid reaction device that is easy to make and assemble.

Another object of the present invention is to provide a fluid reaction device including a rotor with vanes which contact a wall surrounding the cavity without requiring precise dimensional tolerances for the vanes.

It is another object of the present invention to provide a fluid reaction device having a rotor with vanes which pivot with respect to a trunk of the rotor.

Another object of the present invention is to provide a fluid reaction device which minimizes cooling by inhibiting significant adiabatic expansion of drive fluid utilized therein.

It is another object of the present invention to provide a fluid reaction device having a rotor with a trunk, hinges and vanes which can either be all formed integrally together or can be formed separately.

Another object of the present invention is to provide a fluid reaction device with a rotor having vanes which have a first position adjacent a trunk of the rotor and a second position spaced from a trunk of the rotor manufactured to be biased toward the second position.

Another object of the present invention is to provide a fluid reaction device having a substantially constant free speed when unloaded and powered with a constant fluid pressure differential.

Another object of the present invention is to provide an alternative to the air motor featuring a rotor with radially sliding vanes by providing a fluid reaction device featuring a rotor with pivoting vanes.

Another object of the present invention is to provide a device which can be manufactured in a sufficiently economical manner to facilitate disposal after limited use.

Another object of the present invention is to provide a fluid reaction device which is lightweight and can be held in the hand of a user.

It is another object of the present invention to provide a fluid reaction device which delivers high power and high torque with a small diameter.

Another object of the present invention is to provide a fluid reaction device with a rotor oriented offset within a cavity to increase a torque produced by the rotor.

Viewed from a first vantage point it is the object of the present invention to provide a fluid reaction device receiving fluid as input and having a rotating shaft as output, comprising in combination: a rotor including a substantially rigid trunk, a plurality of vanes, and a means to pivotably attach said vanes to said trunk; a hollow cavity, said cavity including means to inlet fluid into said cavity, means to exhaust fluid out of said cavity, and means to rotatably support said trunk of said rotor within said cavity; and an output shaft coupled to said rotor such that when fluid enters said cavity, said shaft is caused to rotate.

Viewed from a second vantage point it is the object of the present invention to provide a method for utilizing fluid to cause a shaft to rotate, including the steps of: forming a rotor to include a trunk and a plurality of vanes, connecting each vane through a hinge to the trunk, the hinge allowing each said vane to pivot with respect to the trunk between a first collapsed position and a second extended position, orienting the rotor within a hollow cavity, providing an inlet fluid port passing into the cavity, providing an outlet fluid port passing into the cavity, coupling the rotor to a means to extract rotational energy from the rotor, coupling the inlet fluid port to a source of fluid, and directing fluid from the source of fluid through the inlet fluid ports and into contact with the vanes of the rotor, causing the rotor to rotate.

Viewed from a third vantage point it is the object of the present invention to provide a fluid reaction device having a substantially constant velocity rotational output comprising in combination: a rotor having a trunk, vanes and hinge means between said trunk and said vanes to pivot said vanes between a first position and a second position, a wall surrounding said rotor, said first position defined by said vanes collapsed adjacent said trunk with a portion of said vanes abutting said wall, said second position defined by said vanes pivoted away from said trunk with a portion of said vanes abutting said wall, an inlet passing through said wall coupled to a source fluid, and an outlet passing through said wall.

Viewed from a fourth vantage point it is the object of the present invention to provide a fluid reaction device for converting elevated energy drive fluid into lower energy drive fluid and rotational power output, comprising in combination: a cavity having a fluid inlet and a fluid outlet, a rotor, means to rotatably support said rotor within said cavity, and vanes attached to said rotor and extending from said rotor, said vanes including a surface exposed to the drive fluid at all times.

These and other objects will be made manifest when considering the following detailed specification when taken in conjunction with the appended drawing figures.

DESCRIPTION OF PREFERRED EMBODIMENTS

Figure 1:
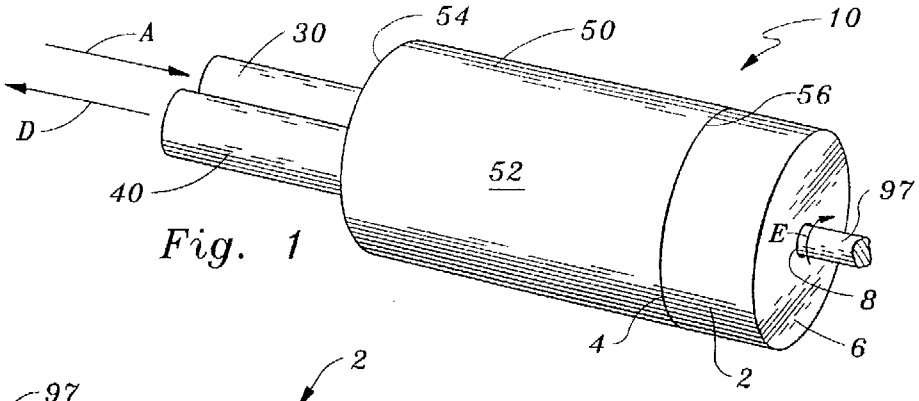
FIG. 1 is a perspective view of the fluid reaction device of this invention as assembled.

Referring to the drawings, wherein like reference numerals represent like parts throughout the various drawing figures, reference numeral 10 is directed to a fluid reaction device. The device 10 (FIG. 1) receives high pressure fluid through an entrance 30 along arrow A, and discharges the fluid through an outlet 40 along arrow D. A rotor 90 (FIG. 2) is addressed by the high pressure fluid in a manner causing an output shaft 97 connected to the rotor 90 to rotate.

Figure 2:
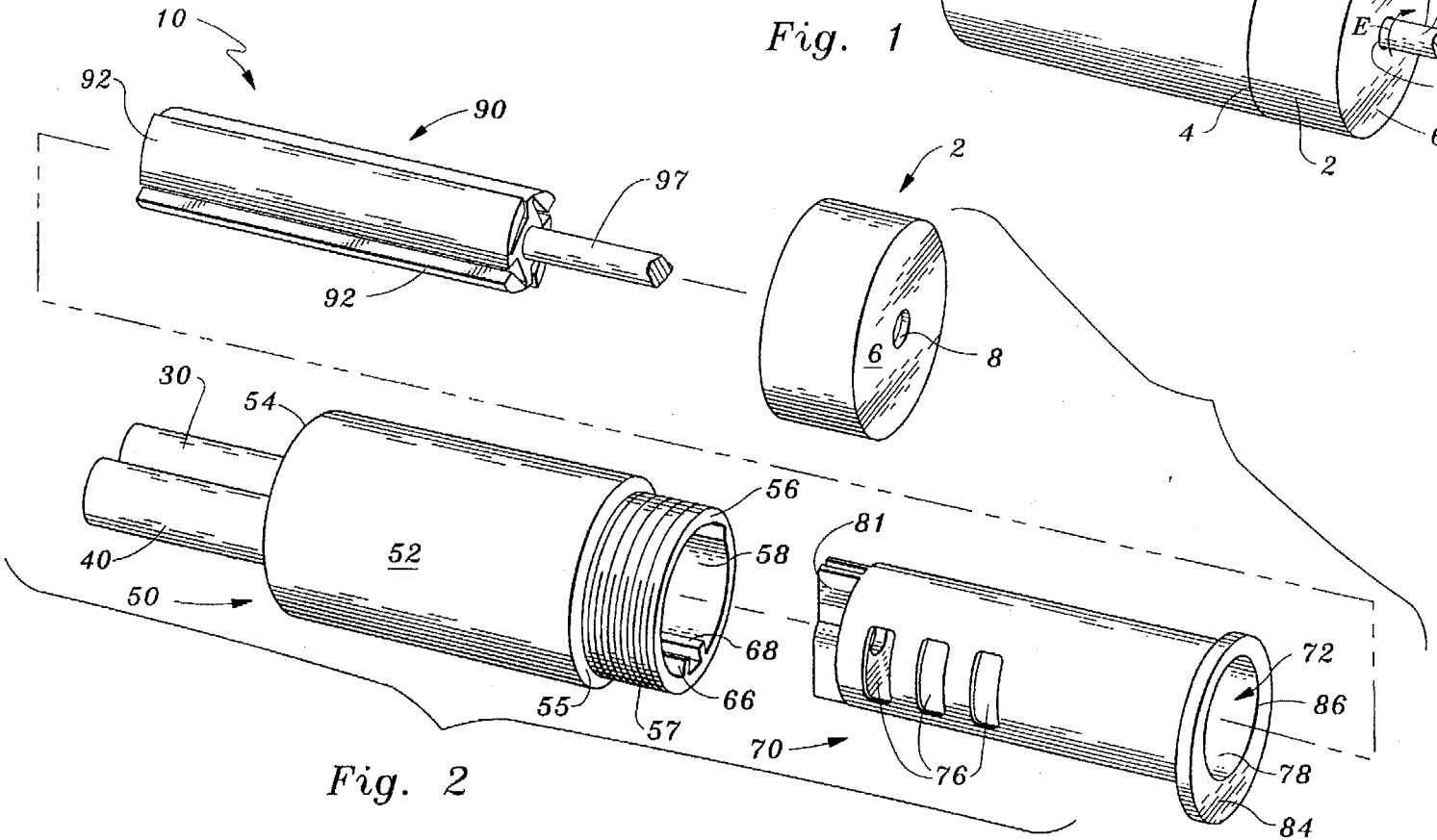
FIG. 2 is a perspective exploded parts view of this invention with individual parts separated according to an order of assembly.
Figure 3:
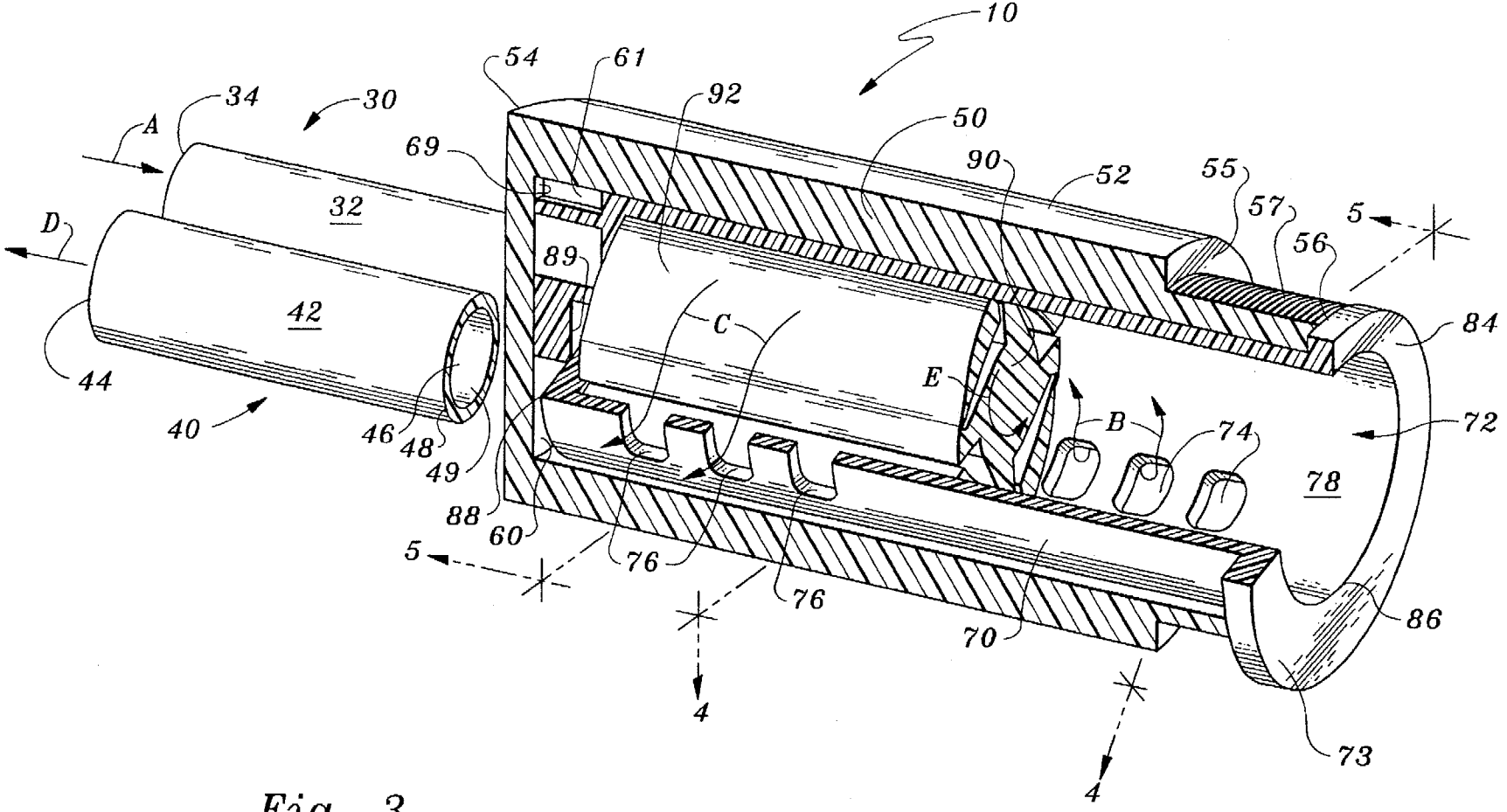
FIG. 3 is a perspective view of that which is shown in FIG. 1 with portions thereof cut away to reveal interior details such as how the fluid passes through the device.
Figure 5:
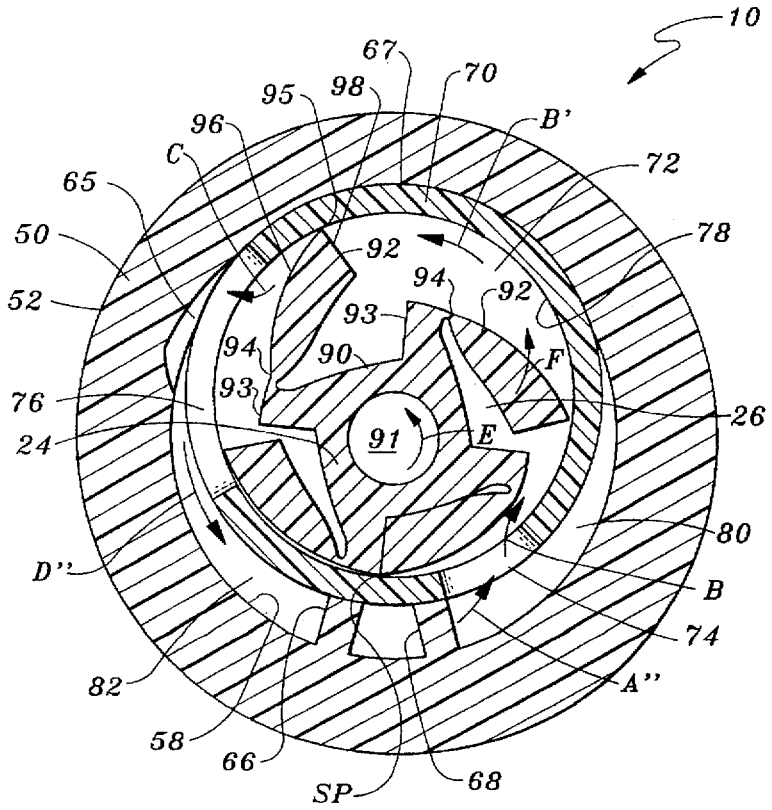
FIG. 5 is a sectional view taken along line 5—5 of FIG. 3.

In essence, and with reference to FIGS. 1 through 3, the device 10 includes the following elements. The entrance 30 and outlet 40 are coupled to a housing 50 in a manner allowing high pressure fluid to pass into and out of the housing 50 through the entrance 30 and outlet 40. An insert 70 is nested within an interior of the housing 50. The insert 70 includes a cylinder 72 which has inlets ports 74 and exhaust ports 76 passing therethrough. The insert 70 is sized smaller than an interior of the housing 50 such that a high pressure chamber 80 and a low pressure chamber 82 are oriented between the insert 70 and the housing 50 (FIG. 5). A first divider wall 66 and second divider wall 68 divide the high pressure chamber 80 and the low pressure chamber 82.

Figure 9:
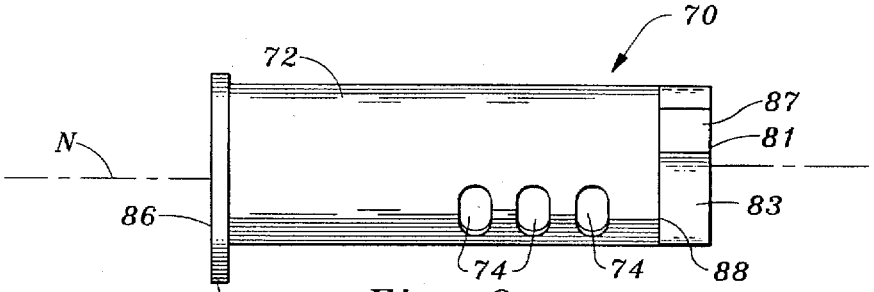
FIG. 9 is an opposite view of the insert portion of this invention.
Figure 10:
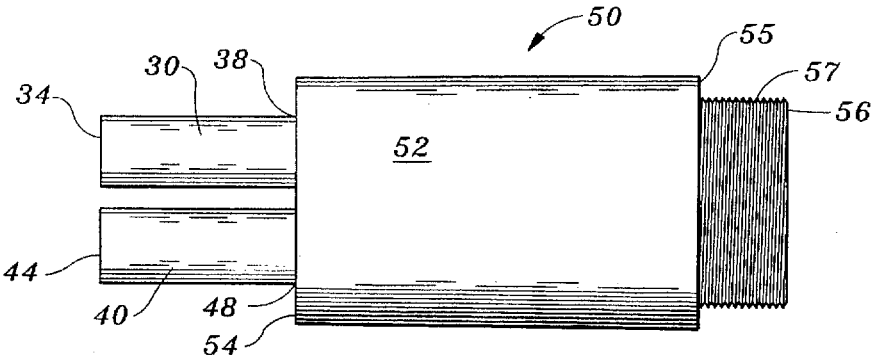
FIG. 10 is a top view of a housing portion of this invention.
Figure 11:
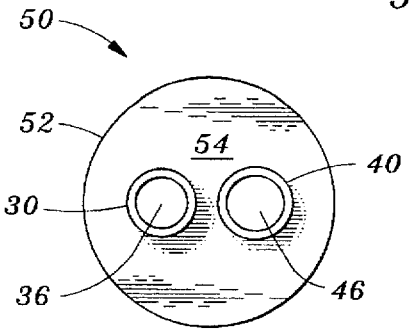
FIG. 11 is a rear view of that which is shown in FIG. 10.
Figure 13:
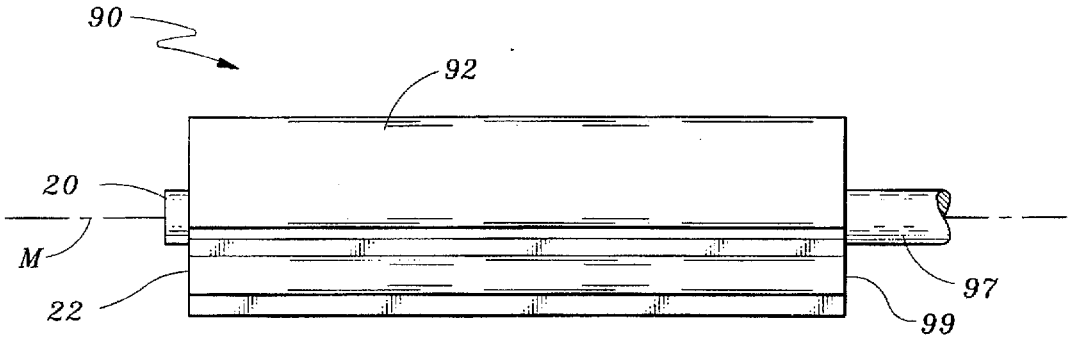
FIG. 13 is a side view of a rotor portion of this invention.
Figure 15:
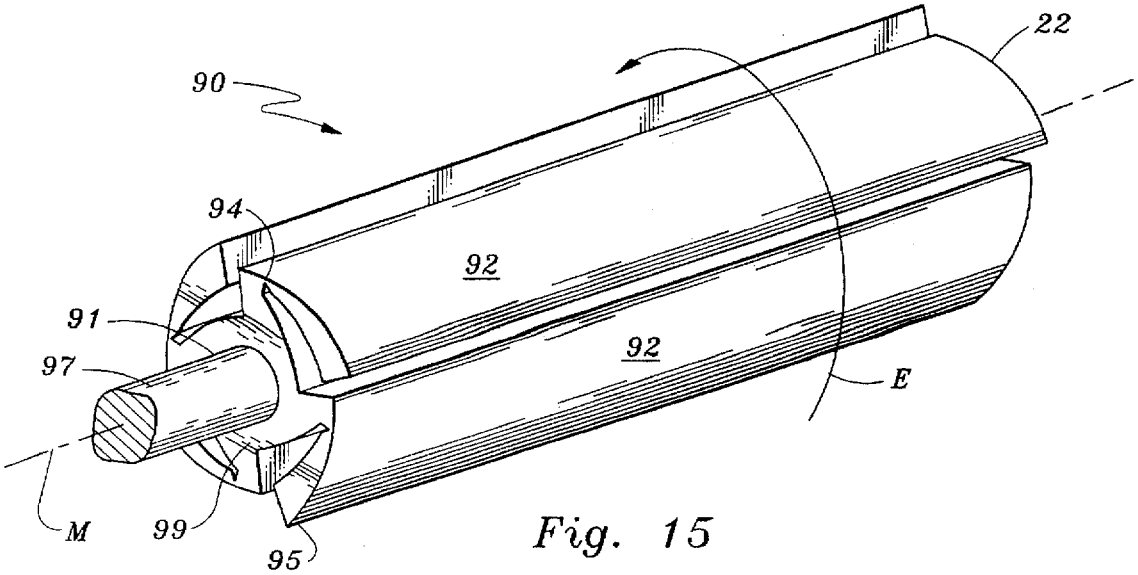
FIG. 15 is a perspective view of the rotor of this invention.

The rotor 90 is rotatably supported within the cylinder 72 of the insert 70. The cylinder 72 provides a cavity for supporting the rotor 90 within the device 10. The rotor 90 includes a plurality vanes 92 pivotably supported by the rotor 90 so that the vanes 92 can pivot between a first position adjacent the rotor 90 to a second position pivoted away from the rotor 90. The rotor 90 is oriented with a rotational axis M (FIGS. 13 and 15) offset from a central axis N of the cylinder 72 (FIG. 9). This offset between the axis M and the axis N allows the vanes 92 to pivot between the first position and the second position as the rotor 90 rotates about arrow E.

High pressure fluid passing through the entrance 30 along arrow A has access to the high pressure chamber 80 and the inlet ports 74. When the high pressure fluid enters the cylinder 72 through the inlet ports 74, the rotor 90 is caused to rotate about arrow E. Rotor 90 rotation in turn causes the output shaft 97 to rotate to perform useful work. The high pressure fluid is simultaneously decreased in pressure, passed through the exhaust ports 76 and the low pressure chamber 82 and then exhausted out of the outlet 40 along arrow D. A cap 2 attaches to an output end 56 of the housing 50 opposite the rear end 54 supporting the entrance 30 and the outlet 40. The cap holds the insert 70 and rotor 90 within the housing 50 while supporting the output shaft 97 and attached rotor 90 in an orientation along rotational axis M.

More specifically, and with reference to FIGS. 1 through 4 and 10 through 12, details of the entrance 30 and outlet 40 are described. The entrance 30 is preferably a hollow cylindrical conduit which extends a short distance perpendicularly away from the rear end 54 of the housing 50. The entrance 30 includes an exterior 32 which is substantially cylindrical and an interior 36 which is substantially cylindrical. The entrance 30 extends from a tip 34 spaced from the rear end 54 of the housing 50 to a root 38 adjacent the rear end 54 of the housing 50.

An interior of the housing 50 includes an access wall 60 substantially parallel to and spaced from the rear end 54 of the housing 50. An influx vent 62 passes through the access wall 60 and rear end 54 at a location adjacent the root 38 of the entrance 30.

The root 38 includes an entrance hole 39 adjacent the interior 36 of the entrance 30. The entrance hole 39 is directly adjacent the influx vent 62 and provides access between the interior 36 of the entrance 30 and the interior of the housing 50.

The outlet 40 is a hollow cylindrical construct extending substantially perpendicularly from the rear end 54 of the housing 50. The outlet 40 includes a cylindrical outer surface 42 concentric with a cylindrical inner surface 46. The outlet 40 extends from an end 44 distant from the rear end 54 to a base 48 adjacent the rear end 54.

An outlet hole 49 defines a portion of the inner surface 46 closest to the base 48 of the outlet 40. The outlet hole 49 is directly adjacent a return vent 64 passing through the access wall 60 adjacent to the influx vent 62. Preferably, the inner surface 46 and outer surface 42 of the outlet 40 are greater in diameter than the interior 36 and exterior 32 of the entrance 30. This dimensional dissimilarity assists in minimizing back pressure in the outlet 40, thereby enhancing performance of the device 10.

Preferably, a stop 45 extends between the entrance 30 and the outlet 40 connecting the exterior 32 to the outer surface 42. The stop 45 provides an indication to a user as to when a high pressure fluid hose placed over the entrance 30 or outlet 40 has been sufficiently slid over the entrance 30 or outlet 40 to mate the hose to the entrance 30 or output 40. The entrance 30 can be coupled to any source of fluid including compressible and incompressible fluid, high pressure and low pressure fluid, and high and low velocity fluid. Preferably, however, the entrance 30 is coupled to an air compressor such that compressed air is supplied through the entrance 30 and into the device 10. The outlet 40 can either be left open to discharge compressed air into the surrounding environment or can have a conduit connected thereto to direct air passing out of the device 10 to a distant location. Alternatively, the outlet 40 can be coupled to a source of vacuum to pull fluid through the device. Alternatively, a combination of both elevated pressure fluid and vacuum could be utilized to provide a "push-pull" system. Preferably, the entrance 30 and outlet 40 are integrally formed with the housing 50. Alternatively, the entrance 30 and outlet 40 can be connected to the housing 50 through use of an adhesive or other fastening means.

With respect to FIGS. 1 through 6 and 10 through 12, details of the housing 50 are described. The housing 50 is essentially a hollow substantially cylindrical construct having an outer cylindrical wall 52 and an inner cylindrical wall 58. The housing 50 extends from the rear end 54 to an output end 56. Adjacent the output end 56, the housing 50 includes a step 55 at which the outer cylindrical wall 52 steps down to a decreased diameter and threads 57 extending between the step 55 and the output end 56. The threads 57 are configured to threadably receive the cap 2 thereon. The inner cylindrical wall 58 extends from the output end 56 to the access wall 60 while maintaining a substantially circular cross section. The access wall 60 includes the influx vent 62 and return vent 64 passing therethrough at locations corresponding with the entrance hole 39 and the outlet hole 49, respectively.

The inner cylindrical wall 58 includes a notch 65 at a portion thereof adjacent to where the exhaust ports 76 of the insert 70 are located. This notch 65 provides excess cross sectional area for fluid to pass out of the cylinder 72, to discourage any back pressure from building up during operation of the device 10. The notch 65 increases a radius of the inner cylindrical wall 58 slightly for approximately a tenth of the inner cylindrical wall 58. Preferably, the notch 65 extends from the rear end 54 to the output end 56 of the inner cylindrical wall 58, for ease in forming the notch 65. Alternatively, the notch 65 can be provided only adjacent the specific locations of the exhaust ports 76.

A first divider wall 66 and second divider wall 68 are provided extending from the inner cylindrical wall 58 toward a geometric center of the housing 50 from the access wall 60 to the output end 56 of the housing 50. The first divider wall 66 and second divider wall 68 preferably extend to a height similar to a difference between a diameter of the inner cylindrical wall 58 of the housing 50 and a diameter of the insert 70. Thus, the divider walls 66, 68 support the insert 70 tightly within the housing 50 while providing the high pressure chamber 80 adjacent the second divider wall 68 and the low pressure chamber 82 adjacent the first divider wall 66.

The divider walls 66, 68 prevent fluid from passing between the high pressure chamber 80 and the low pressure chamber 82. A locator tab 69 is oriented at a junction between the inner cylindrical wall 58 and the access wall 60 at a location rotated approximately 180° away from the divider walls 66, 68. The locator tab 69 extends only slightly away from the access wall 60 and assists in appropriately orienting the insert 70 rotationally within the housing 50 when positioned within a slot 61 in the insert 70.

Figure 12:
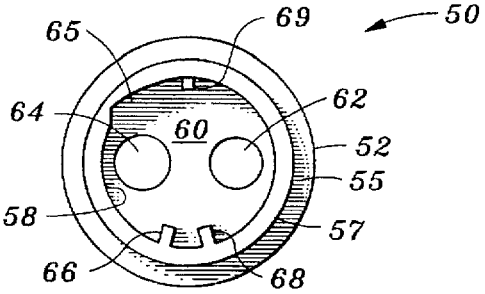
FIG. 12 is a front view of that which is shown in FIG. 10.

As shown in FIG. 5, the inner cylindrical wall 58 can be slightly recessed at a crescent indentation 67 thereof opposite the divider wall 66, 68 to further encourage the insert 70 to be securely held within the housing 50. The crescent indentation 67 has a radius of curvature matching a radius of curvature of the insert 70 and causes a thickness of the housing 50 between the outer cylindrical wall 52 and the inner cylindrical wall 58 to be slightly reduced. Alternatively, as shown in FIG. 12, the inner cylindrical wall 58 can be substantially circular in cross section.

With reference now to FIGS. 2 through 9, details of the insert 70 are described. The insert 70 is preferably a substantially cylindrical hollow construct dimensioned to nest within the interior of the housing 50. The insert 70 includes a cylinder 72 on an interior thereof which is substantially circular in cross section. The insert 70 extends from an end wall 88 configured to be oriented adjacent the access wall 60 of the housing 50 and an open end 86 opposite the end wall 88. The open end 86 includes an annulus 84 thereon which extends radially away from the open end 86 in a plane substantially perpendicular to the central axis N of the cylinder 72. The annulus has a lobe 73 at a lower portion thereof which conforms to a form of the housing 50 at the output end 56. This lobe 73 thus covers ends of the dividers 66, 68. The cylinder 72 within the insert 70 is defined by a cylindrical wall 78 extending from the end wall 88 to the open end 86.

A plurality of inlet ports 74 pass through the insert 70 and into the cylinder 72. The inlet ports 74 are oriented on a side of the insert 70 such that they provide fluid communication between the cylinder 72 and the high pressure chamber 80 within the housing 50. This high pressure chamber 80 is further placed in fluid communication with the influx vent 62 and the access wall 60 so that elevated pressure pneumatic fluid passing through the entrance 30 has fluid access into the cylinder 72 through the inlet ports 74. Preferably, the inlet ports 74 are provided along a line substantially parallel to the central axis N of the cylinder 72. The inlet ports 74 can be located at a variety of different locations between the open end 86 and the end wall 88. Preferably, the inlet ports 74 are located substantially at a mid-point between the open end 86 and the end wall 88.

A plurality of exhaust ports 76 pass through the insert 70 and into the cylinder 72 on a side of the insert 70 opposite that of the inlet ports 74. The exhaust ports 76 are located such that when the insert 70 is located within the housing 50, the exhaust ports 76 are in fluid communication with the low pressure chamber 82. The low pressure chamber 82 is oriented to be in fluid communication with the outlet 40 so that pneumatic fluid exiting the cylinder 72 through the exhaust port 76 can be drawn out of the housing 50 through the outlet 40. Preferably, the exhaust ports 76 are provided along a line substantially parallel to the central axis N and at a mid-point between the end wall 88 and the open end 86.

With reference to FIG. 5, sizes and positions of the inlet ports 74 and exhaust ports 76 are described in detail. Initially, note the location of a seal point SP at a substantially bottom dead center portion of the cylinder 72. The inlet ports 74 begin approximately 15° counterclockwise (FIG. 5) from the seal point SP. The inlet ports 74 preferably extend for approximately 30°. The exhaust ports 76 preferably stop at a location 60° away from the seal point SP. The inlet ports 74 end and the exhaust ports 76 begin with preferably approximately 180° therebetween. While these inlet ports 74 and exhaust ports 76 configurations have been identified as preferred, various different sizes of inlet ports 74 and exhaust ports 76 in various different relative locations of ports 74, 76 can be effectively utilized.

The inlet port 74 and exhaust port 76 are spaced sufficiently apart on a side of the rotor 90 opposite the seal point SP to insure that the inlet port 74 and exhaust port 76 are never in direct fluid communication with each other. This characteristic can be obtained by locating the inlet ports 74 and outlet ports 76 angularly spaced apart by a distance not less than 360° divided by the number of vanes 92. This ensures that the inlet ports 74 and outlet ports 76 are never in direct communication without a vane 92 therebetween. Preferably, as soon as a tip 95 of a vane 92 passes an end of the inlet port 74, a tip 95 of a preceding vane 92 is just passing a beginning of the exhaust port 76. In this way, compression and expansion of the pneumatic fluid is minimized and thermodynamic heating and cooling effects are minimized within the cylinder 72. Preferably, the inlet ports 74 begin sufficiently close to the seal point SP to prevent a substantial amount of vacuum being formed behind the vanes 92 as the vanes 92 rotate counterclockwise (FIG. 5) away from the seal point SP.

The end wall 88 of the insert 70 includes an end wall divider 81 oriented thereon and extending toward the access wall 60. The end wall divider 81 includes a first leg 83 oriented to be positioned adjacent the first divider wall 66 and a second leg 85 oriented to be adjacent the second divider wall 68. The slot 61 is formed in the end wall divider 81 adjacent the locator tab 69. The slot 61 receives the locator tab 69 therein to prevent the insert 70 from rotating within the housing 50. The end wall divider 81 contacts the access wall 60. Thus, the divider 81 prevents pneumatic fluid from passing around the end wall 88 of the insert 70 between the high pressure chamber 80 and the low pressure chamber 82.

The cylinder 72 includes a bearing 89 at a portion thereof adjacent the end wall 88. The bearing 89 is a substantially cylindrical recess having a geometric center slightly spaced from the central axis N of the insert 70. Preferably, the bearing 89 is located such that when the insert 70 is oriented within the housing 50, the bearing 89 has a geometric center thereof oriented along a geometric center line of the housing 50. The bearing 89 assists in supporting the rotor 90 within the cylinder 72 as described below.

With reference now to FIGS. 2 through 5 and 13 through 15, details of the rotor 90 are described. The rotor 90 is sized to nest within the cylinder 72 of the insert 70 and includes a substantially rigid trunk 24 and a plurality of vanes 72 pivotably attached to the trunk 24 of the rotor 90. The rotor 90 preferably has a hollow core 91 passing between a hub end 22 of the rotor 90 and an output end 99 of the rotor 90. The core 91 can receive an output shaft 97 passing entirely therethrough such that the output shaft 97 forms a hub 20 extending slightly from the hub end 22 of the rotor 90 and extends out of the output end 99 for coupling to other rotational shafts or other output devices.

Preferably, the output shaft 97 is formed from a material exhibiting more rigidity than a material forming the trunk 24 and vanes 92 of the rotor 90. The output shaft 97 thus acts as a backbone, preventing the rotor 90 from bending between the hub end 22 and the output end 99. For instance, the trunk 24 and vanes 92 can be formed of a plastic such as a polymeric hydrocarbon while the output shaft 97 can be formed of steel. Alternatively, the shaft 97 is integrally formed from the same material as the trunk 24 and vanes 92.

The trunk 24 surrounds the core 91 and includes a plurality of posts 93 extending away from the trunk 24. The posts 93 preferably extend along lines substantially tangent to the core 91 of the rotor 90. Each post 93 includes a hinge 94 on a trailing portion of an end thereof distant from the trunk 24 which supports a vane 92 thereon. A recess 26 is provided between each post 93 which is preferably shaped to allow one of the vanes 92 to be received within an adjacent recess 26 when sufficient force is applied to the vanes 92 to cause the vanes 92 to pivot about the hinge 94.

The vanes 92 include a forward surface 96 which is arcuate with a radius of curvature similar to a radius of the rotor 90 between the rotational axis M of the rotor 90 and the ends of the posts 93 most distant from the core 91. The recesses 26 are sufficiently deep to allow the vanes 92 to pivot down entirely within the recesses 26 such that no portion of the vanes 92 extend beyond the posts 93 when a rearward surface 98 of each vane 92 opposite the forward surface 96 is adjacent the trunk 24 within the recess 26. When all of the vanes 92 are retracted into the recess 26 of the rotor 90, the rotor 90 exhibits a substantially circular cross-section.

Each vane 92 has a first position entirely within the recess 26 and a second position pivoted out of the recess 26 along arrow F an amount necessary to keep a tip 95 of the vane 92 distant from the hinge 94 in contact with the cylindrical wall 78. The cylinder 72 preferably has a diameter less than a diameter of a circle scribed by the tips 95 of the vanes 92 when the vanes 92 are in the second position, such that the vanes 92 can maintain contact with the cylindrical wall 78.

The hinges 94 are preferably biased such that the vanes 92 are encouraged to extend out of the recesses 26 when no forces are applied forcing the vanes 92 into the recesses 26. This biasing is preferably programmed into the rotor 90 when the rotor 90 is formed. One method of forming the rotor 90 is through injection molding of an organic polymeric material where the vanes 92 and trunk 24 are formed simultaneously as a single unit within an injection mold. The hinge 94 is formed by providing a sufficiently thin portion of the mold to allow bending of the material forming the rotor 90. This method of manufacture greatly reduces a cost and complexity of the device 10, making it more economical for users to dispose of the device 10 after a single use. For instance, medical personnel could use such a motor in a surgical environment and then dispose of it to preclude later contamination from reuse.

The mold is shaped so that the natural position of the vanes 92 is extended out of the recess 26, but is shaped to provide the recesses 26 with a size and shape which allows the vanes 92 to be pivoted into an adjacent recess 26 without extending beyond the posts 93. In this way, each vane 92 is effectively "spring loaded" (i.e., programmed with a memory) to attempt to retract out of the recess 26 at all times. The vanes 92 are preferably formed with a static position similar to the second position. This biasing of the vanes 92 toward the second position helps ensure that the vanes 92 maintain contact with the cylindrical wall 78, especially during start up when no centrifugal force is acting upon the vanes 92. While biasing the vanes 92 is preferred, the rotor 90 can also self-start without biasing.

Figure 14:
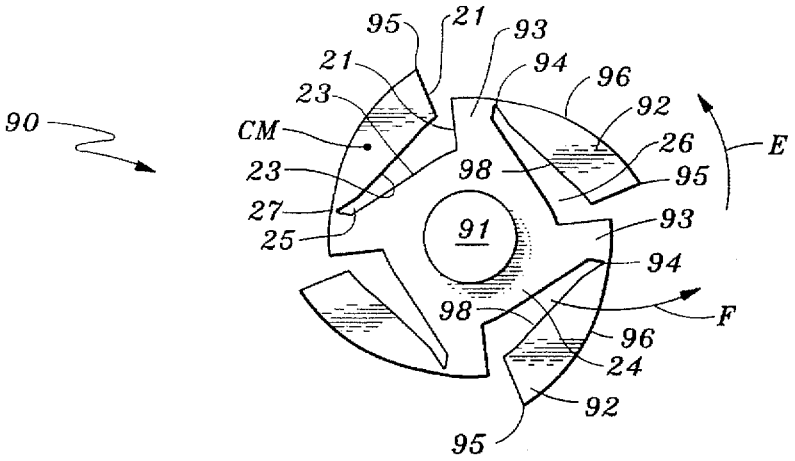
FIG. 14 is a front view of a portion of that which is shown in FIG. 13.

With particular reference to FIG. 14, the rotor 90 can be identified as a radially symmetrical constant cross-section construct. Viewed in section, the rotor 90 preferably includes four identical regions, with each region including one vane 92. However, additional regions can be included. The rotor 90 is circular in crosssection when the vanes 92 are collapsed against the trunk 24. Each vane 92 can be alternatively formed by a radial cut 21, extending from the tip 95 partially toward the core 91, followed by a secant cut 23. The secant cut 23 extends from an inner end of the radial cut 21 to a location just short of a surface 27 of the material, such that remaining material between the secant cut 23 and the surface 27 can be flexed providing the hinge 94. The secant cut 23 adjacent the hinge 94 is slightly widened to form a hinge relief region 25. This region 25 assists in allowing the vane 92 to flex totally into the recess 26 and present a circular surface 27 to the seal point SP (FIG. 4), which maintains contact with the cylindrical wall 78 regardless of the rotational orientation of the rotor 90.

Each vane 92 has a center of mass CM which affects a force with which the vanes 92 address the cylindrical wall 78. The location of the center of mass CM can be adjusted as desired to change a free speed of the rotor 90. For instance, the vanes 92 can be modified in geometry or weights such as higher density material can be added to portions of the vanes 92 during manufacture. Adjusting a location of the center of mass CM also alters a flywheel effect of the rotor 90. With the center of mass CM more distant from the hinge 94, a moment of inertia of the rotor 90 is altered. Also, adding or subtracting weight from the vanes 92 alters the inertia of the rotor 90. The vanes 92 contact with the cylindrical wall 78 acting as a governor for the free speed of the rotor 90. By altering the mass and center of mass CM of the vanes 92, a speed at which the rotor 90 is governed can be altered as desired.

The hub 20 is sized to be rotatably supported within the bearing 89 of the cylinder 72. The bearing 89 and hub 20 thus interact in a journal bearing fashion to support the hub end 22 of the rotor 90. The output end 99 of the rotor 90 is supported by an opening 8 (FIG. 4) formed in the cap 2 which receives the output shaft 97. The opening 8 and bearing 89 are positioned to cause the rotor 90 to have its rotational axis M offset from the central axis N of the cylinder 72. This offset is preferably sufficient to cause the rotor 90 to always contact the cylindrical wall 78 of the cylinder 72 at the seal point SP between the inlet ports 74 and the exhaust ports 76. Thus, a distance between the rotational axis M of the rotor 90 and the central axis N of the cylinder 72 is equal to a radius of the cylinder 72 minus a radius that the posts 93 extend from the rotational axis M. This offset of the axes M, N causes the vanes 92 to, in essence, orbit a geometric center of the trunk 24 as the rotor 90 turns such that the vanes 92 have a perigee adjacent the seal point SP and an apogee opposite the seal point SP and between the ports 74, 76.

Figure 4:
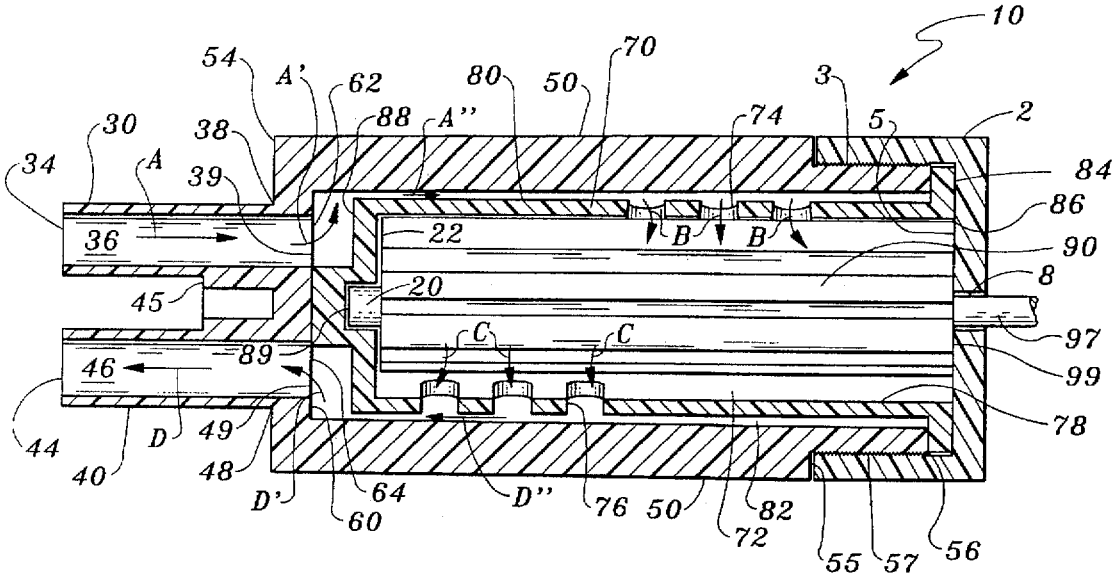
FIG. 4 is a sectional view taken along line 4—4 of FIG. 3.

The cap 2, shown in FIGS. 1, 2 and 4, threads onto the threads 57 of the housing 50 with cap threads 3 until a bearing wall 5 comes into contact with the annulus 84 of the open end 86. The cap 2 includes an open end 6 with the opening 8 located at a center thereof and in alignment with the output shaft 97 when the rotor 90 and insert 70 are oriented within the housing 50. The cap 2 is preferably formed so that when it is entirely threaded upon the threads 57 of the housing 50, fluid flow between the high pressure chamber 80 and low pressure chamber 82 is prevented adjacent the cap 2 and the substantially planar bearing wall 5 is provided for bearing of the output end 99 of the rotor 90 thereagainst. The cap 2 thus holds the insert 70 and rotor 90 within the housing 50.

In use and operation, and with reference to FIGS. 3 through 5, details of the operation of the fluid reaction device 10 are described in detail. Initially, preferably high pressure fluid, such as air, is passed into the entrance 30 along arrow A. The fluid can alternatively be incompressible fluid having a high or low pressure or velocity. The fluid then passes through the entrance hole 39 and influx vent 62 along arrow A' and through the high pressure chamber 80 along arrow A". If low pressure fluid is utilized at high velocity, this fluid would also pass through the chamber 80. The high pressure fluid then enters the cylinder 72 through the inlet ports 74 along arrow B. The fluid passes around the rotor 90 along arrow B', causing the rotor 90 to turn about arrow E.

The rotor 90 is primarily caused to rotate due to a combination of the pressure difference between the high pressure chamber 80 and the low pressure chamber 82 and the offset of the rotor 90 within the cylinder 72. Other factors contributing to rotor 90 rotation can include a velocity of the fluid addressing the vane 92 of the rotor 90 and the ability of the fluid to expand within the cylinder 72. These other factors vary in importance from negligible to substantial depending on the specific configuration of the device 10 and the nature of the fluid utilized by the device 10. In general, incompressible fluids could provide high pressure, high velocity or both to cause rotor 90 rotation. Compressible fluids could provide high pressure, high velocity, expandability or a combination thereof to cause rotor 90 rotation. Torque exhibited by the rotor is maximized by allowing the total surfaces of the vanes 92 to be exposed to the drive fluid rather than just portions thereof as exhibited by prior art sliding vane rotors.

As the rotor 90 rotates along arrow E, the vanes 92 are caused to pivot about the hinge 94 along arrow F. This pivoting is caused by a combination of the biasing built into the hinge 94, centrifugal forces and fluid pressure tending to cause the vanes 92 to extend away from the rotational axis M (FIGS. 13 and 15) of the rotor 90. In fact, if forces resist rotor 90 rotation, the vanes 92 are still caused to pivot along arrow F due to the fluid pressure and torque is exhibited by the rotor 90. The high pressure fluid then comes into contact with the exhaust port 76 where a pressure of the high pressure fluid is decreased. The fluid passes through the exhaust port 76 along arrow C and into the low pressure chamber 82. The fluid then passes along arrow D" through the low pressure chamber 82 to the return vent 64 and outlet core 49 along arrow D' and then out of the outlet 40 along arrow D. If low pressure fluid is utilized, the chamber 82 would support reduced velocity fluid. Rotation of the rotor 90 causes the output shaft 97 coupled thereto to rotate about arrow E (FIG. 1). Each vane 92 preferably passes the outlet ports 76, the seal point SP and then the inlet ports 74, in sequence.

The tips 95 of the vanes 92 preferably remain in contact with the cylindrical wall 78 of the cylinder 72 most of the time. This dragging of the tips 95 of the vanes 92 against the cylindrical wall 78 creates frictional forces which inhibit the rotor 90 from exceeding certain speeds. As the rotor 90 rotates faster and faster, a centrifugal force of the vanes 92 away from the rotor 90 increases, increasing a force that the vanes 92 exert normal to the cylindrical wall 98. In addition, pressure of the fluid against the vanes 92 increases a radially outward force against the cavity wall. This in turn increases a frictional force opposing rotation of the rotor 90, thus limiting speed. Because the vanes 92 pivot into contact with the wall 78, precise tolerances for the vane 92 dimensions need not be maintained during manufacture to provide an appropriate seal between the tips 95 and the wall 78.

Hence, the device 10 is provided with a maximum free speed at which frictional forces generated between the tips 95 of the vanes 92 of the rotor 90 are equal to rotational forces imparted against the vanes 92 of the rotor 90 by the differential pressure between the high pressure chamber 80 and the low pressure chamber 82. As long as a pressure differential exists between the high pressure chamber 80 and low pressure chamber 82, the seal point SP is maintained so that fluid cannot pass from the inlet ports 74 to the exhaust ports 76 through the seal point SP. With the vanes 92 remaining in contact with the cylindrical wall 78, a torque is applied about the rotational axis M of the rotor 90, encouraging the rotor 90 to rotate with or without actual rotor 90 rotation. The cylinder 72 and rotor 90 are configured such that a volume between adjacent vanes 92 and a pressure of fluid between the inlet ports 74 and exhaust ports 76 both remain substantially constant. Thus, a diabetic expansion of the fluid is kept to a minimum. This feature minimizes any thermal effect on the fluid or the device 10, which could otherwise damage the device 10.

Figure 4A:
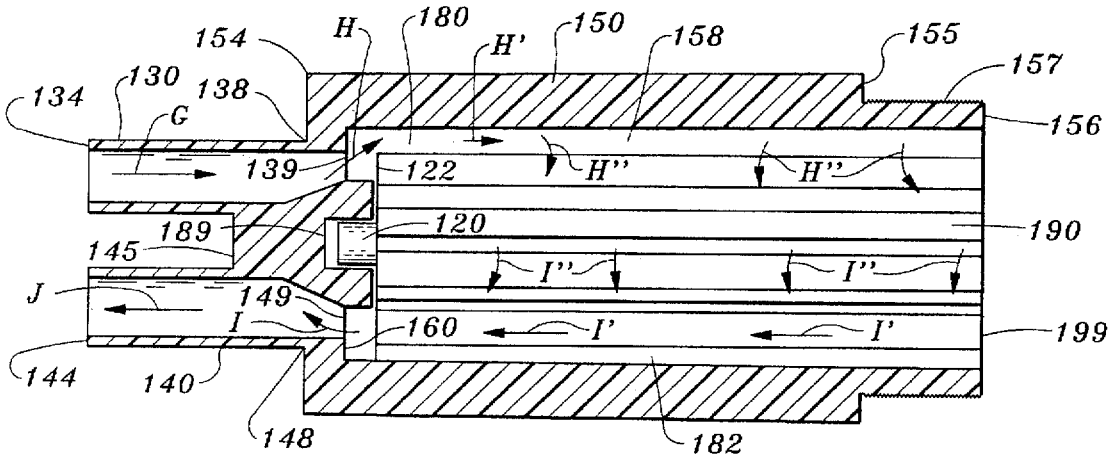
FIG. 4A is an alternative embodiment of that which is shown in FIG. 4.
Figure 5A:
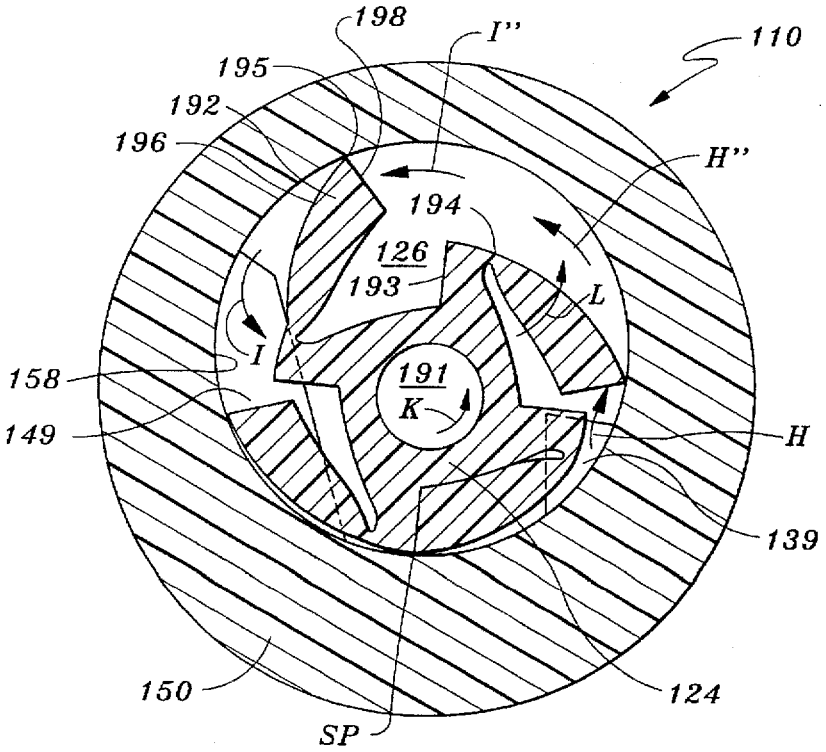
FIG. 5A is an alternative embodiment of that which is shown in FIG. 5.
Figure 7:
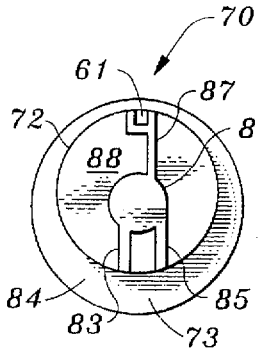
FIG. 7 is a rear view of the insert portion of this invention.
Figure 6:
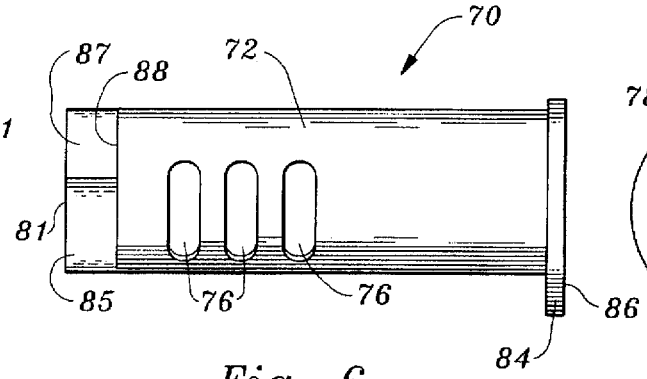
FIG. 6 is a side view of an insert portion of this invention.
Figure 8:
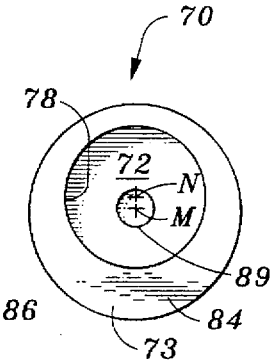
FIG. 8 is a front view of an insert portion of this invention.

With reference now to FIGS. 4A and 5A, details of an alternative embodiment of the device 10 are described. In this alternative embodiment, a device 110 is provided which incorporates essential features of the insert 70 of the preferred embodiment directly into the housing 50 of the preferred embodiment. Hence, a housing 150 is provided having a rear end 154 and an output end 156 with a step 155 therebetween and threads 157 between the step 155 and the output end 156. The housing 150 includes an inner cylindrical wall 158 which provides a cylinder within which a rotor 190 is supported.

The housing 150 includes an access wall 160 which directly supports a bearing 189 thereon to provide rotational support for a hub 120 of the rotor 190. The inlet ports 74 and exhaust ports 76 of the preferred embodiment are replaced with an entrance hole 139 and an outlet hole 149. A stop 145 is interposed between the entrance 140 and outlet 140 to define a depth to which hoses can overlie the entrance 130 and outlet 140. The entrance 130 extends from a tip 134 to a root 138. The outlet 40 extends from an end 144 to a base 148. The inlet hole 139 is interposed between an entrance 130 and a high pressure chamber 180 of the housing 50. The outlet hole 149 is interposed between an outlet 140 and a low pressure chamber 182 oriented within the housing 150.

Preferably, the inlet hole 139 is positioned to minimize a thrust placed on the rotor 190 in a direction away from the entrance 130. This helps minimize any leakage of air around the rotor 190 adjacent the access wall 160. The high pressure chamber 180 and low pressure chamber 182 are spaced apart by the seal point SP and points of contact between the tips 195 of the vanes 192 of the rotor 190 and the inner cylindrical wall 158 of the housing 150.

The rotor 190 extends from a hub end 122 to an output end 199. The hub 120 extends through a core 191 of the rotor 190 and is supported within the bearing 189 of the housing 150. The rotor 190 includes a plurality of posts 193 extending away from a trunk 124 of the rotor 190. Each post 193 supports a hinge 194 thereon which in turn is connected to one of the vanes 192. Each vane 192 includes a forward surface 196 and a rearward surface 198 similar to the surfaces 96, 98 of the rotor 90 of the preferred embodiment.

In use and operation, the device 110 operates in the following manner. Initially, elevated pressure pneumatic fluid passes through the entrance 30 along arrow G. The fluid then passes from the entrance 30 through the entrance hole 139 along arrow H and into the high pressure chamber 180 along arrow H'. The high pressure fluid then rotates around the rotor 190 along arrow H", past a location 180° opposed from the seal point SP along arrow I" and into fluid contact with the low pressure chamber 82 where the fluid is decreased in pressure and migrates along arrow I'. The fluid then passes through the outlet hole 149 along arrow I and then into the outlet 140 along arrow J.

As the fluid passes over the rotor 190, the rotor 190 is caused to rotate about arrow K. Also, the vanes 192 are caused to pivot about the hinge 194 along arrow L and out of recesses 126. The entrance hole 139 and outlet hole 149 are configured such that fluid is prevented from being in direct contact between the high pressure chamber 180 and the low pressure chamber 182 without rotation of the rotor 190.

Moreover, having thus described the invention, it should be apparent that numerous structural modifications and adaptations may be resorted to without departing from the scope and fair meaning of the instant invention as set forth hereinabove and as described hereinbelow by the claims.

I claim:

1. A fluid reaction motor receiving fluid as input and having a rotating shaft as output, comprising, in combination:

a rotor including a substantially rigid trunk, a plurality of vanes, and a hinge means integrally formed with said trunk and vanes to pivotably attach said vanes to said trunk, said rotor formed from thermoplastic material;

a hollow cavity, said cavity including means to inlet fluid into said cavity, means to exhaust fluid out of said cavity, and means to rotatably support said trunk of said rotor within said cavity;

an output shaft coupled to said rotor such that when fluid enters said cavity, said shaft is caused to rotate;

said rotor including said shaft supported on bearing means on a hub, said shaft rotatably supported at a point offset from a central axis of said cavity similar to an amount of spacing between said central axis of said cavity and said bearing means on an end wall; and said output shaft rigidly attached to said trunk of said rotor, whereby when said rotor rotates, said output shaft is caused to rotate;

wherein said means to rotatably support said rotor within said cavity includes a means to support said rotor with a rotational axis of said rotor spaced from a central axis of said hollow cavity;

wherein a seal point is provided between said rotor and said cavity, said seal point located between said inlet means and said exhaust means, said seal point defined by at least one portion of said rotor contacting said cavity between said inlet means and said exhaust means;

whereby fluid passing through said inlet means and into said cavity is prevented from accessing said exhaust means by passing around a side of said rotor closest to said seal point;

wherein said rotor includes a recess adjacent each vane, each said recess having a contour which can receive an adjacent said vane therein when said vane is pivoted about said pivotable attachment means;

wherein said pivotable attachment hinge means includes means to apply a force causing extension of said vane out of an adjacent said recess;

wherein said inlet means includes at least one inlet port passing through said cavity, said inlet ports in fluid communication with a source of elevated pressure compressible fluid;

wherein said outlet means includes at least one outlet port passing through said cavity, said outlet ports in fluid communication with a region having lower pressure than said source of elevated pressure compressible fluid, said outlet ports oriented on a side of said seal point opposite said inlet ports around a side of said cavity including said seal point and spaced from each other on a side of said cavity opposite said seal point by an angular displacement, with reference to said central axis of said cavity, by an angle not less than 360° divided by a number of said vanes extending from said trunk;

whereby compressible fluid is prevented from passing from said inlet ports to said outlet ports directly without rotor rotation taking place;

wherein said hollow cavity has an inside wall which exhibits a radius of curvature adjacent said seal point greater than a radius of said rotor when said vanes are collapsed against said trunk, and wherein said vanes include tips distant from said hinge, said tips of said vanes positioned to allow contact with said wall of said cavity at all times, whereby compressible fluid is prevented from passing from said inlet ports to said outlet ports without rotor rotation;

wherein said trunk of said rotor includes a plurality of posts extending from said trunk, each said post including one of said hinges, each said vane having a shape which allows said vane to be pivoted into an adjacent said recess:

said cavity including a substantially flat circular end wall with a center thereof oriented along a central axis of said cavity, said end wall bearing means including a circular bearing therein at said center thereof sized to receive a cylindrical hub extending from one end of said rotor at a point oriented along said central axis of said rotor, such that said rotor is supported within said bearing, said bearing offset from said central axis of said cavity.

2. A method for utilizing fluid to cause a shaft to rotate, including the steps of:

forming a rotor to include a trunk and a plurality of vanes;

connecting each vane through a hinge to the trunk by integrally forming the hinge and vane with the trunk with thermoplastic material, the hinge allowing each said vane to pivot with respect to the trunk between a first collapsed position and a second extended position;

orienting the rotor within a hollow cavity;

providing an inlet fluid port passing into the cavity;

providing an outlet fluid port passing into the cavity;

coupling the rotor to a means to extract rotational energy from the rotor;

coupling the inlet fluid port to a source of fluid;

directing fluid from the source of fluid through the inlet fluid ports and into contact with the vanes of the rotor, causing the rotor to rotate;

including forming a plurality of posts extending from said trunk, each said post including one of said hinges, each said vane having a shape which allows said vane to be pivoted into an adjacent recess;

providing said cavity with a substantially flat circular end wall, orienting a center thereof along a central axis of said cavity, providing said end wall with a circular bearing therein at said center thereof sized and receiving a cylindrical hub extending from one end of said rotor at a point oriented along said central axis of said rotor, supporting said rotor within said bearing, offsetting said bearing from said central axis of said cavity;

providing an output shaft on an end of said rotor opposite said hub, rotatably supporting said output shaft at a point spaced an amount from said central axis of said cavity similar to an amount of spacing between said central axis of said cavity and said bearing within said end wall; and rigidly attaching said output shaft to said trunk of said rotor, whereby when said rotor rotates, said output shaft is caused to rotate.

3. The method of claim 2 including the further step of biasing the vanes toward the second position such that the vanes extend away from the trunk unless forces are applied against the vanes, causing the vanes to pivot toward the first position adjacent the trunk.

4. The method of claim 3 including the further step of providing the recess in the trunk for each vane such that the recess is sized to receive the vanes therein when said vanes are pivoted into said first position.

5. The method of claim 4 including the further step of regulating a speed of said rotor by:

shaping said cavity with a circular cross-section and sizing said cavity with a diameter less than a diameter scribed by tips of the vanes most distant from the trunk when the vanes are in the second position, such that the vanes can contact the cavity at all times where frictional forces increase with increasing velocity and increasing pressure.

6. The method of claim 5 including the further step of offsetting the rotor within the cavity such that at least one of the vanes of the rotor can be in contact with the cavity when the vane is in the first position adjacent the trunk, defining a seal point between the rotor and the cavity which remains at a substantially constant location upon the cavity, and locating the inlet and the outlet on opposite sides of the seal point;

whereby fluid passing into said cavity through the inlet is caused to rotate around the rotor on a side of the rotor spaced from the seal point and then to the outlet, causing the rotor to rotate.

7. A fluid reaction motor having a substantially constant velocity rotational output, comprising, in combination:

a rotor formed from thermoplastic material and having a trunk, vanes and hinge means integrally formed with said trunk and said vanes to pivot said vanes between a first position and a second position;

a wall surrounding said rotor;

said first position defined by said vanes collapsed adjacent said trunk with a portion of said vanes abutting said wall;

said second position defined by said vanes pivoted away from said trunk with a portion of said vanes abutting said wall;

an inlet passing through said wall coupled to a source of fluid;

an outlet passing through said wall;

wherein said trunk of said rotor includes a plurality of posts extending from said trunk, each said post including one of said hinges, each said vane having a shape which allows said vane to be pivoted into an adjacent said recess;

a substantially flat circular end wall enclosing one end of said rotor surrounding wall, said end wall including a circular bearing therein at its center thereof sized to receive a cylindrical hub extending from one end of said rotor at a point oriented along a central axis of said rotor, such that when said rotor is supported within said bearing, said bearing is offset from said central axis of said rotor surrounding wall;

said rotor including an output shaft on an end thereof opposite said hub, said output shaft rotatably supported at a point spaced from said central axis: and said output shaft rigidly attached to said trunk of said rotor, whereby when said rotor rotates, said output shaft is caused to rotate.

8. The motor of claim 7 wherein said wall is substantially circular in cross-section and has a central axis at a geometric center thereof, said wall including means to rotatably support said rotor therein with a rotational axis of said rotor offset from and parallel to said central axis of said wall.

9. The motor of claim 8 wherein a seal point is provided between said wall and said rotor at a point along said wall closest to said rotational axis of said rotor, said seal point located along said wall at a point not including said inlet or said outlet.

10. The motor of claim 9 wherein said inlet and said outlet are positioned such that said vanes of said rotor pass said seal point, said inlet and said outlet in sequence, said rotational axis of said rotor oriented sufficiently close to said wall to cause said vanes to be oriented in said first position when said vanes pass said seal point and to allow said vanes to contact said wall when said vanes pass a point on said wall opposite said seal point with said vanes in said second position.

11. The motor of claim 10 wherein said vanes on said rotor are spaced from each other by a distance determined by and less than an amount of spacing between said inlet and said outlet, on a side of said wall opposite said seal point, whereby fluid is prevented from passing between said inlet and said outlet without rotor motion.

12. A motor for converting elevated energy drive fluid into lower energy drive fluid and rotational power output, comprising in combination:

a cavity having a fluid inlet and a fluid outlet;

a rotor;

means to rotatably support said rotor within said cavity;

vanes integrally formed with said rotor via a hinge means and extending from a trunk of said rotor, said vanes including a surface exposed to the drive fluid;

wherein said trunk, of said rotor includes a plurality, of posts extending from said trunk, each said post including one of said hinges, each said vane having a shape which allows said vane to be pivoted into an adjacent said recess;

said cavity including a substantially flat circular end wall with a center thereof oriented along a central axis of said cavity, said end wall including a circular bearing therein at said center thereof sized to receive a cylindrical hub extending from one end of said rotor at a point oriented along said central axis of said rotor, such that said rotor is supported within said bearing, said bearing offset from said central axis of said cavity;

said rotor including an output shaft on an end thereof opposite said hub, said output shaft rotatably supported at a point spaced an amount from said central axis of said cavity similar to an amount of spacing between said central axis of said cavity and said bearing within said end wall;

said output shaft rigidly attached to said trunk of said rotor, whereby when said rotor rotates, said output shaft is caused to rotate.

13. The motor of claim 12 wherein said vanes include means to move relative to said rotor a sufficient distance away from said rotor to contact a wall of said cavity at all rotational positions.

14. The motor of claim 13 wherein said rotor is rotatably supported upon a rotational axis stationary with respect to said cavity and located off-center from a geometric center of said cavity.

15. The motor of claim 14 wherein said means to move said vanes includes a means to allow said vanes to pivot with respect to said rotor from a first position adjacent said rotor to a second position extended away from said rotor and contacting said wall of said cavity.

16. A fluid reaction motor receiving fluid as input and having a rotating shaft as output, comprising, in combination:

a rotor including a substantially rigid trunk, a plurality of vanes, and a hinge means integrally formed with said trunk and vanes to pivotably attach said vanes to said trunk, said rotor formed from thermoplastic material;

a hollow cavity, said cavity including means to inlet fluid into said cavity, means to exhaust fluid out of said cavity, and means to rotatably support said trunk of said rotor within said cavity;

an output shaft coupled to said rotor such that when fluid enters said cavity, said shaft is caused to rotate;

wherein said means to rotatably support said rotor within said cavity includes a means to support said rotor with a rotational axis of said rotor spaced from a central axis of said hollow cavity;

wherein a seal point is provided between said rotor and said cavity, said seal point located between said inlet means and said exhaust means, said seal point defined by at least one portion of said rotor contacting said cavity between said inlet means and said exhaust means;

whereby fluid passing through said inlet means and into said cavity is prevented from accessing said exhaust means by passing around a side of said rotor closest to said seal point;

wherein said rotor includes a recess adjacent each vane, each said recess having a contour which can receive an adjacent said vane therein when said vane is pivoted about said pivotable attachment means;

wherein said pivotable attachment hinge means includes means to apply a force causing extension of said vane out of an adjacent said recess;

wherein said inlet means includes at least one inlet port passing through said cavity, said inlet ports in fluid communication with a source of elevated pressure compressible fluid;

wherein said outlet means includes at least one outlet port passing through said cavity, said outlet ports in fluid communication with a region having lower pressure than said source of elevated pressure compressible fluid, said outlet ports oriented on a side of said seal point opposite said inlet ports around a side of said cavity including said seal point and spaced from each other on a side of said cavity opposite said seal point by an angular displacement, with reference to said central axis of said cavity, by an angle not less than 360° divided by a number of said vanes extending from said trunk;

whereby compressible fluid is prevented from passing from said inlet ports to said outlet ports directly without rotor rotation taking place;

wherein said hollow cavity has an inside wall which exhibits a radius of curvature adjacent said seal point greater than a radius of said rotor when said vanes are collapsed against said trunk, and wherein said vanes include tips distant from said hinge, said tips of said vanes positioned to allow contact with said wall of said cavity at all times, whereby compressible fluid is prevented from passing from said inlet ports to said outlet ports without rotor rotation;

wherein said trunk of said rotor includes a plurality of posts extending from said trunk, each said post including one of said hinges, each said vane having a shape which allows said vane to be pivoted into an adjacent said recess;

said cavity including a substantially flat circular end wall with a center thereof oriented along said central axis of said cavity, said end wall including a circular bearing therein at said center thereof sized to receive a cylindrical hub extending from one end of said rotor at a point oriented along said central axis of said rotor, such that said rotor is supported within said bearing, said bearing offset from said central axis of said cavity;

said rotor including an output shaft on an end thereof opposite said hub, said output shaft rotatably supported at a point spaced an amount from said central axis of said cavity similar to an amount of spacing between said central axis of said cavity and said bearing within said end wall;

said output shaft rigidly attached to said trunk of said rotor, whereby when said rotor rotates, said output shaft is caused to rotate.

17. A fluid reaction motor receiving fluid as input and having a rotating shaft as output, comprising, in combination:

a rotor including a substantially rigid trunk, a plurality of vanes, and a hinge means integrally formed with said trunk and vanes to pivotably attach said vanes to said trunk, said rotor formed from thermoplastic material;

a hollow cavity, said cavity including means to inlet fluid into said cavity, means to exhaust fluid out of said cavity, and means to rotatably support said trunk of said rotor within said cavity;

an output shaft coupled to said rotor such that when fluid enters said cavity, said shaft is caused to rotate;

wherein said trunk of said rotor includes a plurality of posts extending from said trunk, each said post including one of said hinges, each said vane having a shape which allows said vane to be pivoted into an adjacent said recess;

said cavity including a substantially flat circular end wall with a center thereof oriented along a central axis of said cavity, said end wall including a circular bearing therein at said center thereof sized to receive a cylindrical hub extending from one end of said rotor at a point oriented along said central axis of said rotor, such that said rotor is supported within said bearing, said bearing offset from said central axis of said cavity;

said rotor including an output shaft on an end thereof opposite said hub, said output shaft rotatably supported at a point spaced an amount from said central axis of said cavity similar to an amount of spacing between said central axis of said cavity and said bearing within said end wall; and said output shaft rigidly attached to said trunk of said rotor, whereby when said rotor rotates, said output shaft is caused to rotate.

* * * * *